United States Patent [19]

de Vos et al.

[11] 4,398,239

[45] Aug. 9, 1983

[54] LUMINAIRE ADAPTED FOR HORIZONTAL AND VERTICAL OPERATION

[75] Inventors: Hendrik A. J. de Vos, Swansea, Mass.; Ronald L. Sitzema, Jr., Ellsworth, Mich.

[73] Assignee: GTE Products Corporation, Stamford, Conn.

[21] Appl. No.: 240,343

[22] Filed: Mar. 4, 1981

[51] Int. Cl.[3] ..... F21S 1/10; F21S 3/10

[52] U.S. Cl. ..... 362/263; 362/145; 362/372; 362/220; 362/374; 362/270; 362/285; 362/310; 362/338; 362/368

[58] Field of Search ..... 362/145, 147, 217, 220, 362/225, 277, 269, 270, 285, 310, 336–339, 365, 367, 368, 372, 374, 375, 263

[56] References Cited

U.S. PATENT DOCUMENTS

| | | | |
|---|---|---|---|
| 3,283,140 | 11/1966 | Rex . | |
| 3,350,556 | 10/1967 | Franck et al. . | |
| 3,377,477 | 4/1968 | Odle . | |
| 3,561,682 | 2/1971 | Rex . | |
| 3,590,238 | 6/1971 | Arens | 362/285 |
| 3,836,767 | 9/1974 | Lasker | 362/217 |
| 3,858,042 | 12/1974 | Peterson | 362/374 |
| 4,300,187 | 11/1981 | Fletcher | 362/368 X |
| 4,337,507 | 6/1982 | Lasker | 362/367 X |

*Primary Examiner*—Peter A. Nelson

*Attorney, Agent, or Firm*—Lawrence R. Fraley

[57] ABSTRACT

A luminaire particularly suited for outdoor applications (e.g., for illuminating roadways and alleyways) and including a two-part housing wherein one of the parts (the base) is metallic and the other (refracting portion) is of lightweight (plastic) material and includes both an opaque chamber for housing the luminaire's lightweight rectangular aluminum reflector and a refracting, multi-planar prismatic lens. The reflector is slidably positioned in the chamber portion and thus readily removable when both parts of the housing are separated. The luminaire is capable of providing a predetermined scheme of light distributions (including IES types II, III, and IV) on the ground therebelow when oriented in either a horizontal or vertical position.

15 Claims, 12 Drawing Figures

LUMINAIRE ADAPTED FOR HORIZONTAL AND VERTICAL OPERATION

DESCRIPTION

1. Technical Field

The invention relates to luminaires and particularly to luminaires designed for outside applications. Even more particularly, the invention relates to such luminaires which utilize a high intensity discharge lamp and which provide light distribution patterns designed primarily for illuminating roadways, alleyways, etc.

2. Background

Outdoor luminaires are typically of ovate configuration and include an oval top part which houses the luminaire's reflector component, and an oval refracting lens which is usually hinged to the upper housing part and provides a closure therefor. Examples of such devices are illustrated in U.S. Pat. Nos. 3,283,140 (Rex), 3,377,477 (Odle), 3,350,556 (Franck), and 3,561,682 (Rex). It is also known in the art to provide luminaires of the above variety in non-ovate shapes such as the rectangular configuration shown in U.S. Pat. No. 4,028,541 (Franklin). In this device, the glass panel enclosure is also hingedly secured to the top housing.

One particular problem inherent in known outdoor luminaires of the variety above is the relative difficulty encountered in gaining access to the internal components thereof in the event that repair and/or replacement is necessary, said difficulty partly the result of the aforementioned hinged and similar arrangements between the housing and lens (or glass) enclosure. It is most often necessary in such devices to provide a separate means of access (in addition to that for the device's light source) to enable one to also remove or repair the ballast components located within the typical luminaire.

One particular disadvantage of known outdoor luminaires such as described above is the limited usage for each such device. More specifically, existing luminaires of this variety are typically capable of operating in only one position (usually either vertical, horizontal, or slightly tilted upwardly from horizontal) and thus do not lend themselves to more versatile mounting arrangements. Accordingly, it is necessary to provide completely different lens and reflector designs whenever one seeking to illuminate a specified ground area with a horizontally oriented (or slightly tilted) luminaire now chooses to illuminate the same area with a luminaire arranged vertically. This understandably adds significantly to the costs of such devices, in addition to the aforementioned limited application thereof.

It is believed therefore that a luminaire capable of overcoming the aforementioned disadvantages, etc. associated with existing such luminaires by providing a luminaire capable of operation in both horizontal and vertical orientation would constitute a significant advancement in the art. It is also believed that a luminaire providing the additional features and advantages defined in greater detail below would constitute an art advancement.

DISCLOSURE OF THE INVENTION

It is, therefore, a primary object of the invention to provide a luminaire which overcomes the disadvantages cited above, thus enhancing the current state of the art.

It is another object of the invention to provide a luminaire which provides the several, significantly advantageous features described hereinbelow, thus even further enhancing the art.

These and other objects are accomplished by the present invention wherein there is provided a luminaire which is capable of being successfully operated in both a horizontal and a vertical orientation. In addition, the invention as described below is designed to provide a well recognized and preferred distribution (e.g., type II or III) while horizontally disposed and a second, somewhat different but also widely acceptable distribution (e.g., type IV) when vertically positioned.

BRIEF DESCRIPTION OF THE DRAWINGS

FIGS. 4–6 represent the various mounting positions for the invention, FIG. 4 illustrating the vertical, while FIGS. 5 and 6 illustrate the horizontal;

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
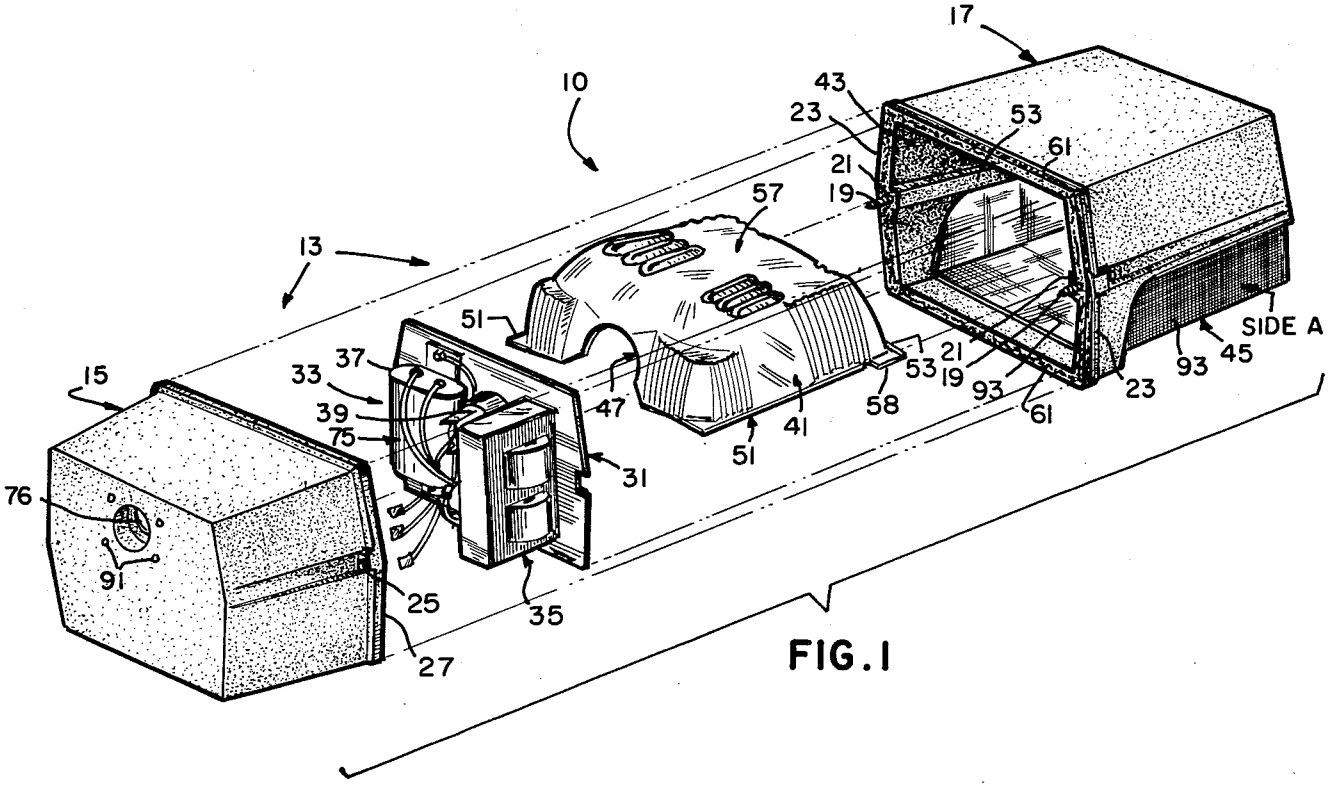
FIG. 1 is an exploded perspective view of a luminaire in accordance with a preferred embodiment of the invention.

With particular reference to FIG. 1, there is illustrated a luminaire 10 in accordance with a preferred embodiment of the invention. Luminaire 10, as will be further defined below, is particularly adapted for outdoor use (e.g., street and alley illumination) and is designed to provide a light distribution pattern suitable therefor while oriented in either a vertical or horizontal manner. The preferred patterns in such applications are IES (Illuminating Engineering Society) type II, type III and type IV, although it is understood that luminaire 10 is capable of providing additional distributions. Greater detail as to these operational aspects (e.g., light distributions) of the invention is provided below.

Luminaire 10 includes a housing 13 which is comprised of two parts, a base or mountable portion 15 and a forward refracting portion 17 of unitary construction. The refracting portion 17 is readily separable from base 15 to permit quick access to the interior of housing 13 (and the various components therein, particularly the luminaire's light source) for purposes of repair and/or replacement and, as will also be further explained below, to enable one to readily remove the luminaire's reflector should it be desired to substitute a different refracting portion and therefore provide a different scheme of distribution patterns. As an example of what is meant by the term readily separable, the forward refracting portion 17 of housing 13 is attached to base portion 15 by only two screws 19 which pass through corresponding openings 21 each located within a flange 23 which in turn extends from one of two opposing sides of portion 17. Screws 19 align with and are finally secured within threaded openings 25 (see also FIG. 3) which in turn are located on opposite sides of base 15. As shown in FIG. 1, base 15 also includes a flange 27 which extends about the periphery of the substantially rectangular opening 29 defined by this part of the housing. It can thus be understood from the foregoing that the forward portion of housing 13 can be removed completely from the remainder (base 15) in only a few seconds.

Figure 2:
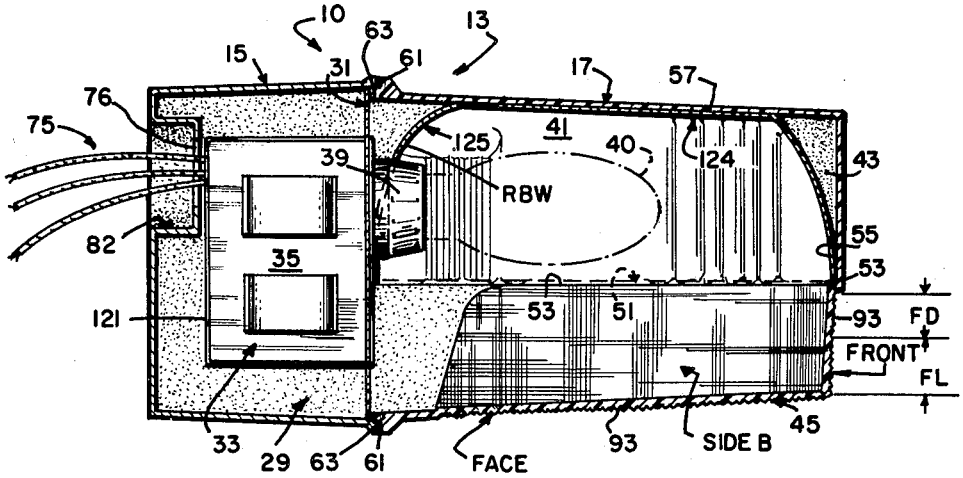
FIG. 2 is an enlarged, side elevational view, partly in section, of the luminaire of FIG. 1, as assembled.
Figure 3:
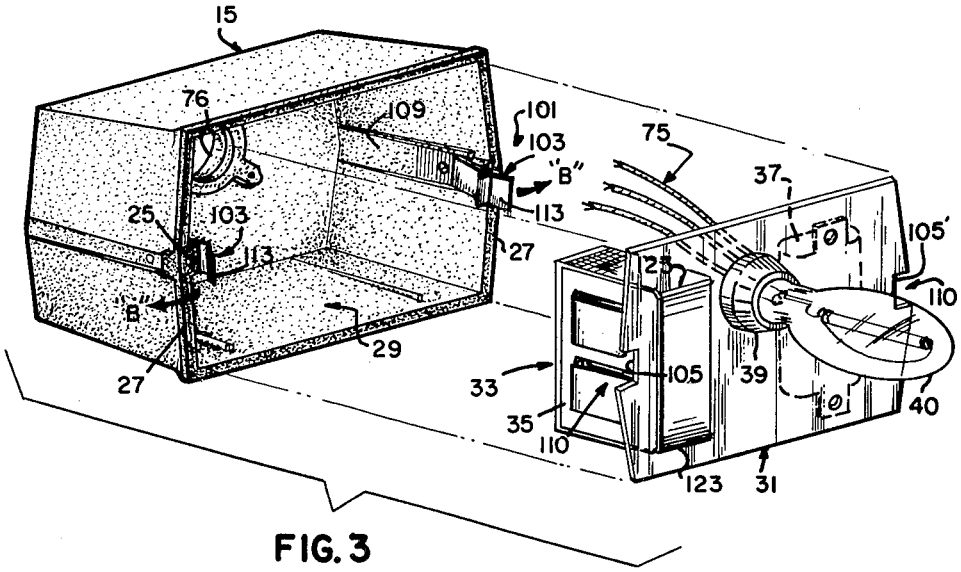
FIG. 3 is an exploded perspective view of the base portion of the invention's housing, and the component mounting plate (with components secured thereto) which is adapted for being releasably positioned within the base.

Luminaire 10 further includes a component mounting plate 31 which is positioned within housing 13 and includes thereon the lamp ballast components 33 for use with the invention. These components include a ballast 35 and starter (lamp igniter) 37 which are located on opposite sides of the flat (planar) plate 31 and separated by a socket 39 in which is positioned the desired light source for use with the invention. The preferred light source is a high intensity discharge (HID) lamp 40 (FIGS. 2,3). HID lamps are those having a gaseous discharge arc tube and operate at pressures and current densities sufficient to generate the desired amount of visible radiation within the respective arcs. Such lamps are popular in the outdoor lighting field because of their high efficacy (more lumens per watt of consumed power), long operating life and sound lumen maintenance, and compactness of design. HID lamps generally fall within one of three categories: mercury lamps (typically containing a small quantity of mercury and a suitable starting gas such as argon within their arc tube), metal halide lamps (including mercury and argon, as above, in addition to a mixture of metallic iodide additives such as sodium, thallium, or indium), and high pressure sodium lamps (containing mercury and sodium, in addition to xenon which is ionized by a short high voltage pulse). Of these, the most preferred for use herein is a high pressure sodium lamp and even more particularly, one designed to be extremely energy efficient. Specifically, the high pressure sodium lamps preferably used in the invention produce 50, 70, or 100 watts and operate at voltage levels of 120, 208, 240, and 277 volts. In one specific example, lamp 40 produced 70 watts while operating at normal line voltage (120 volts). The ballast member 35, needed as a current limiter to prevent self-destruction because of the negative resistance characteristic (as the current therethrough increases, the lamp's resistance decreases) of HID lamps, is rated at 120 volts, 60Hz, and 1.6 Amps, and can be purchased from the Advance Transformer Company, Chicago, Ill., under catalogue number 71A7900. The preferred starter (igniter) 37 needed to provide the aforedefined short, high voltage pulse, is also available from the Advance Transformer Company, under catalogue number L1-551-B5.

Lamp 40 is positioned within a porcelain socket 39 which, as stated, is substantially centrally positioned within component plate 31. Socket 39 is pulse rated at 4 KV, and also possesses a 660 watt —600 volt operational rating.

In addition to the above components, luminaire 10 further includes a reflector 41 which is positioned within the refracting portion 17 of housing 13 such that lamp 40 is recessed therein (FIG. 2). Reflector 41 is of generally rectangular configuration and is located within an opaque chamber portion 43 of this refracting part of the housing. Reflector 41 is preferably highly polished or vacuum metallized aluminum having many highly reflective interior surfaces of spherical, cylindrical, and parabolic shapes arranged in a predetermined manner to direct light from lamp 40 through a light-transmitting, multiplanar prismatic lens 45 (the reflector's rectangular opening 44 facing lens 45) located immediately adjacent opague chamber 43 to provide the selected light distribution scheme. A more detailed explanation of these reflective surfaces, including how each contribute to a corresponding portion of lens 45, is provided below with the description of FIGS. 7–11. The rear portion of reflector 41 includes a recess 47 therein designed to accommodate socket 39 (FIG. 2) such that the envelope of lamp 40 can extend (or project) within and be surrounded by the reflector in the manner shown. As will be described, the reflector and lens components of the invention combine to provide a certain light distribution scheme. Assuming that luminaire 10 is providing one of these and it is later desired at the location in which the invention is utilized to change to the other, it is only necessary to separate the two part housing 13, remove reflector 41, and replace the refracting portion 17 with one possessing the refracting characteristics desired. The new portion 17 will, understandably, be similar in configuration to the original (so as to mate with base 15 and accommodate reflector 41) except for its refracting capabilities. Reflector 41 thus serves as a common component for both housings formed and never needs replacement except in situations of repair. This procedure is facilitated by the fact that reflector 41 is only slidably located within portion 17 of housing 13 and can thus be quickly removed. More specifically, the reflector includes a flange 51 along both opposing sides thereof, each of which mates with and slides along a corresponding ledge 53 formed by the upper surface of lens 45. Reflector 41 is thus simply slid within refracting portion 17 of housing 13 until its forward edge 53 engages an internal, forward wall 55 of portion 17. In this position, the reflector's top surface 57 abuts and lies flush against the interior of the top wall of portion 17 (FIG. 2) such that the reflector assumes a relatively snug (through readily removable) position therein. This snug type of retention is further assured by provision of a pair (one shown) of projecting tabs 58 which each extend from a respective flange 51 at the forwardmost portion of reflector 41. Tabs 58 add to the overall forward width of the reflector such that an interference fit will be achieved between this part of the reflector and the inside of the refracting portion 17 (at the forwardmost end) when the reflector is in its final position in portion 17. It is understood that the aforedescribed fit still enables one repairing luminaire 10 or substituting a new forward portion 17 to readily remove the reflector by simply grasping the exposed, rear portion thereof and, firmly, pulling the reflector out of portion 17. It is also preferred in the invention to slightly taper (front to back) the forward refracting portion 17 as well as the reflector to further assure the snug fit described above. This tapered relationship is best illustrated in FIG. 2

With particular attention to FIG. 2, the component mounting plate 31 of the invention is shown as being secured within base portion 15 of the invention's housing such that it is partially recessed therein. In this position, the aforedescribed ballast components are oriented within the boxlike base and thereby separated from the remaining components (e.g., lamp 40, reflector 41, and lens 45) by the planar plate member 31. Plate 31 thus serves as a cover for the rectangular, planar opening 29 defined by boxlike portion 15. It can therefore be seen that when the refracting portion 17 of housing 13 is separated from base 15, lamp 40 can be quickly removed without the necessity for performing additional manipulations such as loosening, pivoting, or even total removal of the plate member. It is thus only necessary to remove two screws (19) before one has complete access to the lamp of the invention in the event that replacement thereof is necessary. To assure a weathertight seal between both parts of housing 13, a neoprene gasket 61 is employed and positioned about a collar 63 formed on flange portion 23 and surrounding the planar, rectangular opening defined by the forward refracting portion 17, which, like base 15, is also of boxlike configuration. With gasket 61 thereon, collar 63 is adapted for being snugly inserted within the corresponding rectangular opening 29 in base 15 in the manner depicted in FIG. 2. Screws 19 are thereafter tightened, forming a weathertight seal between both housing parts. Gasket 61 is understandably also of substantially rectangular configuration.

Figure 4:
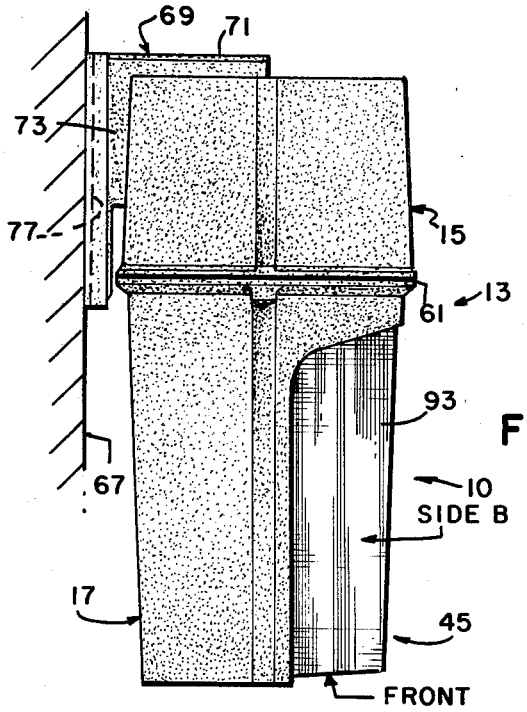
Figure 5:
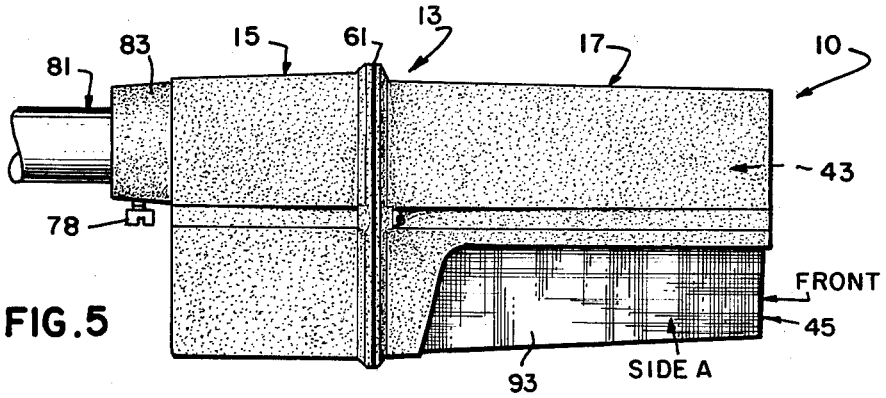
Figure 6:
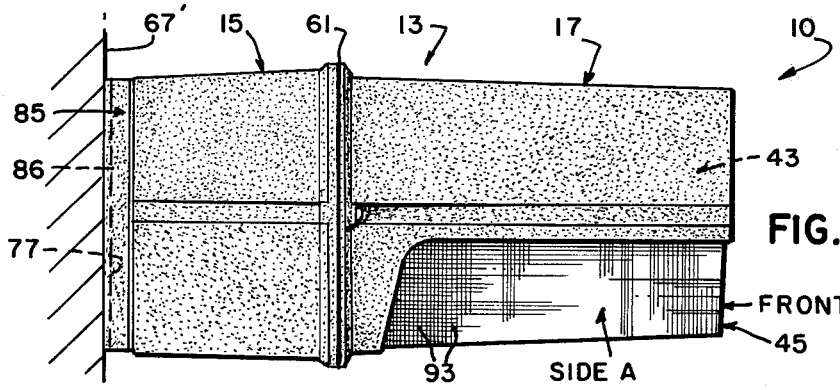

With particular reference to FIGS. 4–6, there are shown various possible mounting positions for luminaire 10. In FIG. 4, luminaire 10 is illustrated in a vertical position with base portion 15 of housing 13 secured (e.g., bolted) to a wall 67. To provide this orientation, a wall mounting member 69 is utilized, said member of substantially L-shaped configuration having a horizontal (upright) arm 71 secured (e.g. bolted) to the back (or top) wall of base 15 and a vertical arm 73 for lying flush to wall 67. The wiring 75 (FIGS. 1–3) used in luminaire 10 to electrically connect the invention to the corresponding line current necessary for its operation passes through a slot or similar opening (not shown) in the upright arm 71 (after initially passing through an aperture 76 within the back wall of base 15) and thereafter through an opening (not shown) in the flush-mounted arm 73, where it can be connected to corresponding wiring located within wall 67. In this arrangement, it is preferred to utilize a planar mounting plate 77 (hidden) which is first secured (e.g., bolted) to wall 67. Plate 77 includes a central aperture (not shown) therein to permit the desired wiring to pass therethrough. Accordingly, the arm portion 73 of member 69 is designed (includes opposing flanges to define a channel therebetween) to slide over the outer surfaces of plate 77 and thereafter be secured in fixed relation thereto (e.g., using a bolt which passes through an opening in arm 73 and into a corresponding recess in one of the plate's side surfaces). To further facilitate this positioning, both plate 77 and arm 73 can be similarly tapered. It is understood that this positioning occurs subsequent to attachment of member 69 to luminaire 10, thus eliminating the requirement for one installing the unit to simultaneously hold the unit and attempt securing member 69 to wall 67. Mounting of luminaire 10 is therefore a relatively simple and safe procedure. In the position depicted in FIG. 4, it is understood that the lamp 40 (not shown) of the invention is oriented in an inverted manner (envelope facing down). This does not adversely affect the operation of luminaire 10, however, in view of the ability of the lamp to operate equally as efficiently and effectively in this position as it does when horizontally arranged or slightly tilted upward from horizontal (as is typical in most known outdoor luminaires). When luminaire 10 is so vertically positioned, the light emitted therefrom is primarily in a forward, downward direction to produce the aforedescribed IES distribution on the surface below the luminaire. A typical mounting height (distance from ground to lens 45) is within the range of ten to twelve feet.

In FIGS. 5 and 6, luminaire 10 is depicted in its two horizontal mounting positions. With particular reference to FIG. 5, the invention is shown secured to a pole 81 using a slipfitter 83 which in turn is attached (e.g., bolted) to base 15 of housing 13. The invention's wiring 75, after passing through aperture 76 in base 15, passes through an opening (not shown) in slipfitter 83 and then into pole 81 where it is connected to the respective wiring therein. To prevent moisture, insects, dust, etc. from passing into base portion 15 at this location, it is preferred to employ a neoprene gasket (not shown) which is positioned between the rear wall of base 15 and the slipfitter 83 (e.g., in mating recesses located in each) and includes an opening therein through which pole 81 may pass so as to be partly inserted within base 15 (in the rear indentation portion 82 depicted in FIG. 2). Final securement of pole 81 relative to the slipfitter and base 15 can be achieved by set screw 78 which passes through the slipfitter's outer wall and engages a corresponding exterior surface of pole 81.

With particular attention to FIG. 6, luminaire 10 is also positioned horizontally and, instead of being secured to a pole, is attached to a wall 67′ using the aforedescribed mounting plate 77 (hidden) which is attached (e.g., bolted) to the wall in the flush arrangement shown. Base 15 may thereafter be slidably located on plate 77 in much the same manner as described above in FIG. 4. Specifically, a planar mounting member 85 is employed and attached to the back wall of base 15 (e.g. using bolts). Member 85 includes opposing flanges (not shown) which define a channel therebetween, said flanges slidably engaging opposing side surfaces 86 of plate 77 during positioning. In such an arrangement, it is also preferred (as above) to taper these opposing side surfaces 86 (one facing the viewer in FIG. 6) as well as the flanges of member 85 such that the member will rest snugly when in its final, secured position. The invention's wiring 75 passes through base aperture 76 (as above) and thereafter through an opening (not shown) in the flush plate 77. Connection is thereafter achieved with the respective wiring in wall 67′.

It is understood with regard to all of the aforedefined mounting orientations that the various mounting items (L-shaped member 69, slipfitter 83, and planar member 85) are attached at the respective locations (walls 67, 67′, pole 81, and base 15) using suitable gasketing sufficient to provide an adequate weathertight seal at said locations and therefore prevent exposure of wiring 75 and the internal components 33 of the invention to such adverse elements as moisture, dust, etc. In addition, attachment of the above items is facilitated by the provision of several (e.g., four) holes 91 (FIG. 1) in the back wall of base 15 and also providing a similar number arranged in an identical pattern within the corresponding mounting item. It is therefore only necessary for the installer of the invention to align these hole patterns, pass the desired mounting bolts therethrough, and attach corresponding nuts and washers as needed.

One of the truly advantageous features of the invention is that it is extremely lightweight in comparison to most known outdoor luminaires. By way of specific example, housing 13, when using the materials specified below, weighs only about two pounds, eight ounces, with the unitary refracting portion 17 accounting for only about one pound, two ounces of this, and base 15 the remainder. Reflector 41, being aluminum as described, weights only about six ounces, while mounting plate 31, having the aforedescribed ballast, igniter, and socket components secured thereto, weighs only four pounds, twelve ounces. The entire luminaire, excluding lamp 40 and the various mounting items shown in FIGS. 4–6, thus weighs only about seven pounds, ten ounces, and it must be emphasized that a significant portion of this total weight is due to the presence of the ballast transformer 35, itself a relatively heavy component. Excluding components 33 and mounting plate 31, the total weight of housing 13 and reflector 41 is, remarkably, less than three pounds.

As stated, housing 13 is of two-part (forward, refracting portion 17 and base portion 15) construction with each part being of substantially boxlike configuration. To provide the above reduction in weight and the several advantages associated therewith (including the following), both parts are manufactured from different materials with those of forward, refracting portion 17 being the lightest. More specifically, base portion 15, adapted for being secured to the aforedefined pole or wall members using the described mounting items, is metallic, and preferably die-cast aluminum. Use of this material assures that this portion of housing 13 will not only be lightweight but also sturdy and rugged, thus able to withstand relatively high forces exerted therea-gainst, said forces typically found in the outdoor environment as well as during positioning and repair of the luminaire. In comparison, refracting portion 17 is of plastic material and, surprisingly, of a unitary construction such that the multiplanar prismatic lens 45 and opaque chamber portion 43 of this component are formed simultaneously from the same material. The material for portion 17 is a thermoplastic, and more preferably, polycarbonate. This entire member is formed using an injection molding procedure, after-which the desired opaque chamber portion is painted (lens 45 having been properly masked). It is therefore only necessary to paint either the interior or the exterior unmasked surfaces of this portion of housing 13. In like fashion, the metal (aluminum) base portion 15 is also painted, preferably with the same paint used on the refracting portion.

As shown, both the internal and external surfaces of each planar wall of lens 45 include several individual prisms 93 therein which are arranged in a predetermined manner to coordinate with the spherical, cylindrical, and parabolic reflecting portions of reflector 41 to produce the desired distribution scheme in the manner defined below. A better understanding of how these elements of the invention combine to provide the results achieved is provided below with the description of FIGS. 7–12. The important feature to note is that combining these elements in the manner defined enables the invention, quite surprisingly, to produce either a type II or III distribution while the luminaire is mounted in the horizontal mode (FIGS. 5, 6) and a type IV distribution in the vertical position depicted in FIG. 4. This feature is deemed truly unique in that it assures the invention a degree of mounting versatility heretofore unknown. In addition, to change these distribution schemes, it is only necessary to separate the extremely lightweight refracting portion 17 from base 15, slidably remove reflector 41 from within portion 17, and replace portion 17 with one capable of providing the other distribution scheme. Such a replacement is of substantially similar external configuration to its predecessor (excluding the lens pattern) so no further adjustments, alterations, etc. are required.

In order to permit ready manufacture of the relatively complex refracting portion 17 using an injection molding procedure (which enables mass production of the invention in large quantities, thus significantly reducing the cost thereof), each of the individual prisms 93 of the two opposing sides (SIDES A, B in FIG. 7) and face (FACE in FIG. 7) within the interior surface of light-transmitting lens 45 run lengthwise; that is, from the front (FRONT in FIG. 7) of the lens toward the back thereof, thus allowing facile mold plunger withdrawal. Those prisms 93 located on the internal surface of the refractor's FRONT wall run perpendicular to the planar FACE member. In contrast, those prisms 93 formed within the four external surfaces of the four-sided, multiplanar lens 45 run transverse to their internal counterparts (as indicated clearly in the cross-sectional views shown in FIGS. 2 and 10). These external prisms are of substantially identical widths to provide a smoothing effect on the outgoing light and to function in the manner defined below. It is also significant to note that lens 45 does not include a house (or base) refracting component. This feature eliminates the need for such an added element and thus allows the opaque portions of the housing to define the desired cut-off of light in this region of luminaire 10. This characteristic is totally unlike most known outdoor luminaires which, as stated, utilize a bowl-shaped lens, as well as a corresponding bowl-shaped upper housing, thus relying on subtractive means (the house side of the lens being required to divert light away from said side) to control illumination to the house side areas. In summary, the use of radial lens elements in combination with corresponding reflecting surfaces of the different configurations cited above, enables the invetion to accomplish with a plane surface (refracting component 45 in FIG. 2) substantially the same results as heretofore provided by often complex, bowl-shaped lens members.

One truly unique feature of the unitary refracting portion 17 is the elimination of the requirement to provide a gasket between the lens and housing members, heretofore deemed essential in known luminaires by virtue of the individual construction thereof. Understandably, an improper seal between such members enables moisture, dust, etc. as typically found in an outdoor environment to enter the luminaire and possibly adversely affect the components therein (e.g., cause lamp 40 to fracture, reduce the reflecting characteristics of reflector 41, etc.). Such a possibility is eliminated by the invention wherein the forward portion 17 of housing 13 is a singular, unitary component and therefore formed of the same material.

In addition, use of a substantially lightweight material (thermoplastic) for this entire portion of luminaire 10 assures a reduced moment arm at the end of the luminaire's housing, particularly when the invention is horizontally oriented as in FIGS. 5 and 6. This feature in turn reduces the potential stresses exerted on both base 15 and the corresponding wall or pole to which the base is secured. Still further, use of a lightweight refracting member assures a positive seal between both housing parts by use of only the two retention screws shown, particularly as a result of base 15 being secured as indicated.

With added reference to FIG. 3, there is illustrated a latching means 101 in accordance with a preferred embodiment of the invention, said means 101 providing releasable securement of the planar component mounting plate 31 within base 15 such that the plate properly covers the rectangular opening 29 defined by this box-like portion of the invention's housing. Latching means 101 includes a pair of opposingly oriented depressible, resilient members 103 which engage opposite edges 105 and 105' of plate 31 during positioning of this element. Members 103, each a leaf spring attached (e.g., bolted or welded) to a corresponding interior surface 109 of base 15, are biased in a first, closed position and thereafter forced to a second, open position ("B") when engaged by edges 105 and 105'. As also shown in FIG. 3, plate 31 includes a three-sided indentation 110 within each of the opposite sides thereof with each of said engaging edges 105 or 105' comprising one of the three sides thereof, preferably the bottom. Accordingly, each leaf spring 103 aligns with a respective indentation 110 during plate positioning and includes a forward cam surface 113 which, when slidably engaged by a respective edge 105', is forced to the open position. The biasing force exerted by spring 103 toward the closed position is thus overcome by the greater force created by this engagement, said force acting opposite to the biasing force. This unique form of releasable securement not only assures positive retention of plate 21 within base 15 but also assures precisioned alignment thereof such that socket 39 and lamp 40 will be accurately oriented. It can be clearly understood that even slight misorientation of the plate (and therefore the lamp and socket) can in turn misalign the arc tube of HID lamp 40 relative to the several reflective surfaces of reflector 41 and therefore possibly alter the illumination levels at locations on the surface illuminated by the invention. Such misalignment is prevented by latching means 101 which provides for both lateral and depth positioning of plate 31. As described, means 101 does so in a manner which enables quick removal of the plate to thereby allow for facile repair and/or replacement of the invention's ballast components, wiring, etc. Such a unique means of plate securement also understandably facilitates assembly of luminaire 10, thus further reducing manufacturing costs thereof. The peferred material for each spring 103 is 0.025 inch thick stainless steel. Dimensionwise, each spring has an overall (before forming to the configuration illustrated) length of 1.50 inch and a width of 0.375 inch. Understandably, each indentation 110 is only slightly wider.

The preferred means of securing the ballast transformer 35 to plate 31 is also depicted in FIGS. 2 and 3. More particularly, ballast 35 is held against the flat back surface of plate 31 by a strip of metal strapping 121, which passes through spaced slots 123 within plate 31 to positively engage the forward surface of the plate and provide the retention desired. The metal strip is overlapped and secured in a manner conventional to strapping techniques and is thus not illustrated here. Such a technique provides positive securement of ballast 35 and is relatively inexpensive in comparison to most known mounting procedures (which typically require seveal manual manipulations, including bolt aligning and fastening). The preferred strapping material is zinc coated steel, said material having a thickness of about 0.016 inch and a width of 0.375 inch. To provide added fastening thereof, a second metal strap member (not shown) is utilized and crimped over the secured portions of the strapping. Use of this additional member provides added securement which may be necessary in situations of high vibration, etc.

As stated, luminaire 10 is capable of producing an I.E.S. type II or type III distribution while horizontally oriented, depending on which lens element is utilized. Regardless of which lens, however, the resulting I.E.S. distribution produced in the vertical operating mode is an I.E.S. type IV. How this is accomplished is explained in greater detail below.

Figure 7:
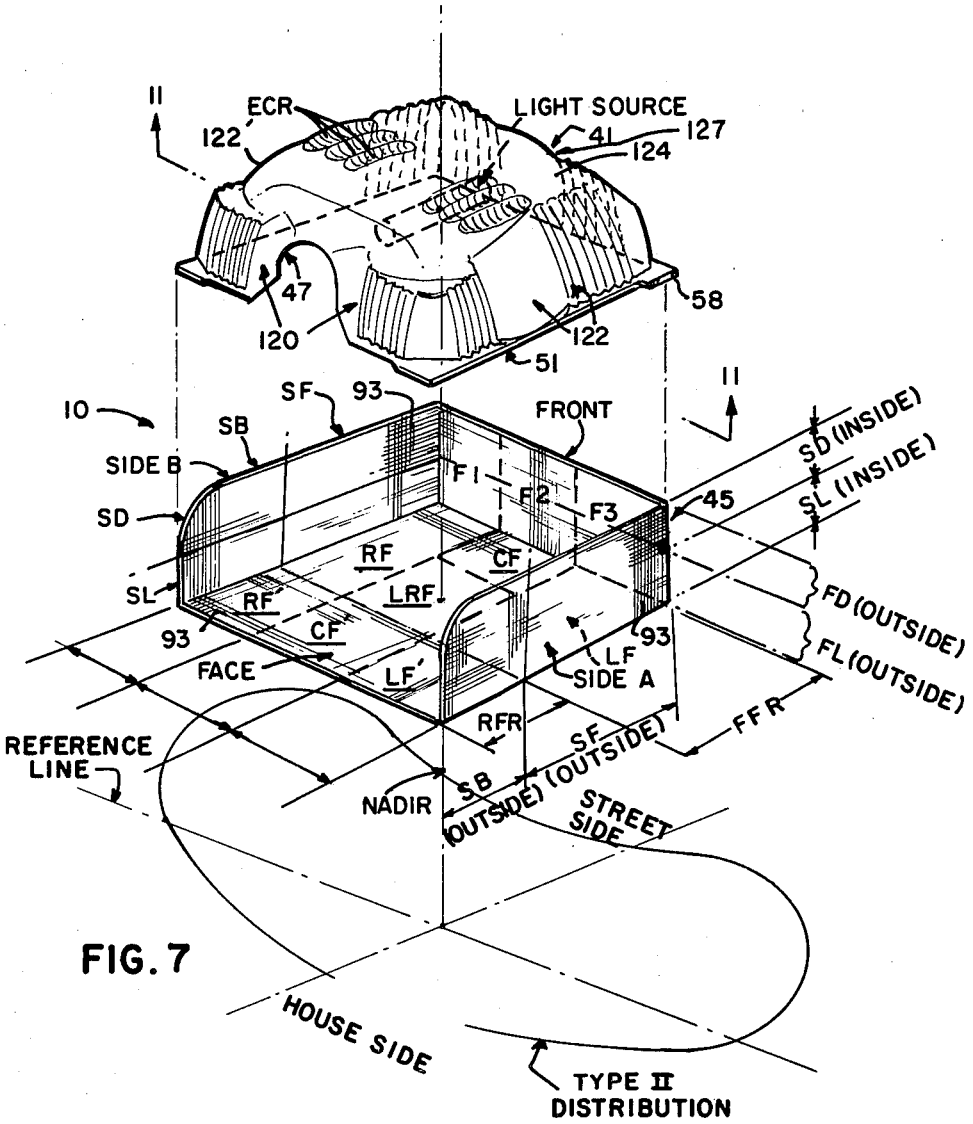
FIG. 7 is an exploded perspective view illustrating the reflector and lens members of the invention when the invention is oriented horizontally and how these number cooperate functionally with the invention's light source to produce a candlepower candela trace (light distribution) shown in diagrammatic form below the members.

With particular regard to FIG. 7, there is illustrated in exploded perspective fashion the reflector 41 and lens 45 elements of the invention as unit 10 is oriented in a horizontal manner (as in FIGS. 5 and 6). Below these two members in schematic form is shown one example of the light distribution produced by the invention, in this case a type II. As stated, this distribution may be either I.E.S. type II or type III, depending on the lens utilized. For what is meant by the terms "type II," "type III," etc., attention is directed to pages 20 through 20-14 of the *I.E.S. LIGHTING HANDBOOK*, 5th edition, J. E. Kaufman (1972), a well-recognized publication in the lighting industry. As stated therein, a type II distribution is somewhat narrower (in lateral dimensions) than its type III counterpart, whereas a type IV is classified as being broader than both the type II and III distributions relative to a reference line dividing the house and street sides (shown). Even more specifically, both the type II and III distributions provided by the invention when in its horizontal orientation are further defined as being of the medium, semi-cutoff variety. Accordingly, the type IV distribution provided by the invention in its vertical position when using the lens members to produce either of these distributions (II,III) is defined as being of the long variety.

Figure 11:
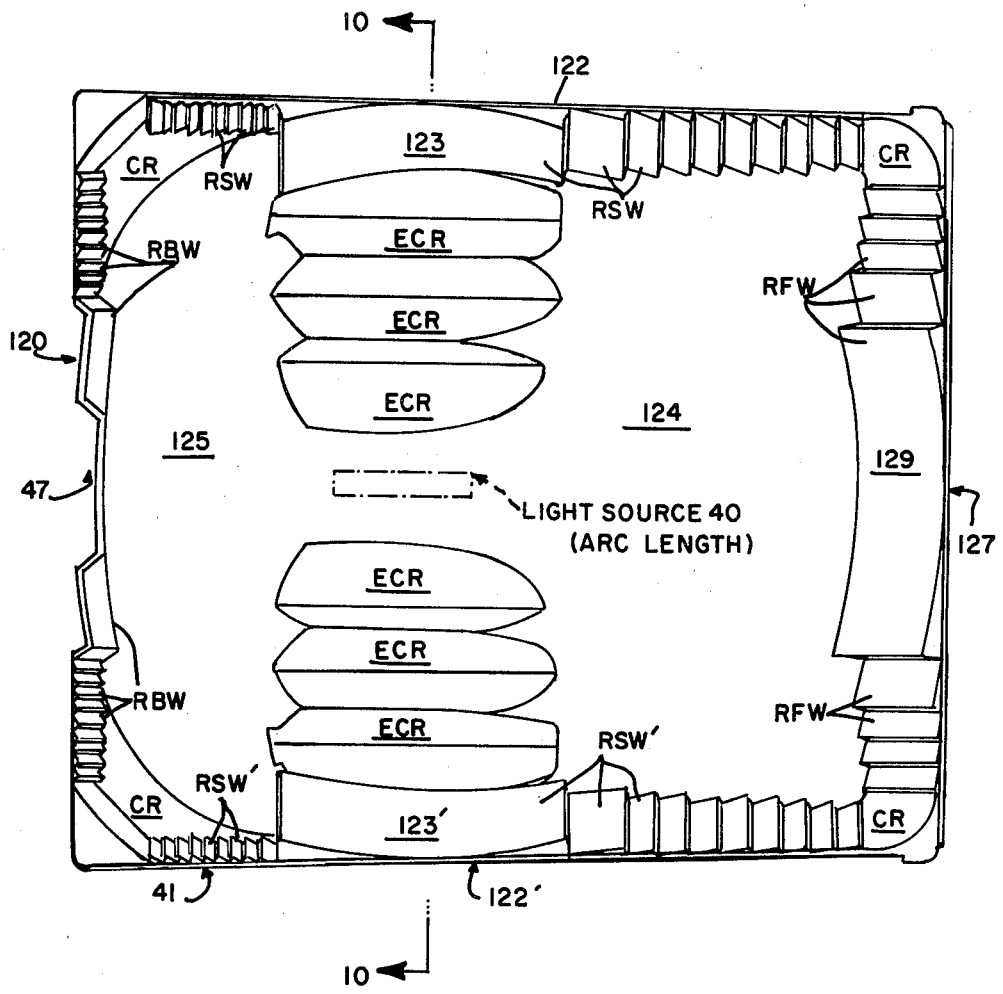
FIG. 11 is a bottom plan view of a preferred embodiment of the invention's reflector, as taken along the line 11—11 in FIG. 7.

As stated, the invention constitutes the utilization of a reflector having a plurality of diverse reflecting surfaces (cylindrical, parabolic, spherical) which cooperate with a four-sided, multiplanar lens member which in turn includes a plurality of individual prismatic lens elements located on both, opposing surfaces of each side to produce the aforedefined schemes of light distribution. A better understanding of how this is accomplished can best be obtained from an explanation of how each reflective surface contributes to each corresponding lens surface and how the double-sided prisms on each lens surface function to deviate the light passing therethrough onto the distribution below. More particularly, the light impinging on the inner reflective surfaces (RBW in FIG. 11) of the reflector's back wall 120 is directed primarily onto the planar front (FRONT) wall of lens 45. Surfaces (or facets) RBW, in the profile view as depicted in FIG. 11, if joined end-to-end to form a smooth, uninterrupted surface, would comprise a parabola in relation to the invention's light source. However, in order to form the substantially rectangular configuration for reflector 41, these surfaces are arranged in the stepped fashion shown such that those located at the extreme ends of the parabola (on each side of the larger parabolic surface having opening 47 therein) may occupy the reflector's corner regions, thus enabling light to also pass to adjoining surfaces on the opposing sides of the reflector. In elevation (as in FIG. 2), each of these surfaces RBW lso forms a parabola (semi) with the light source to thus assure a dual mode of reflection of light from lamp 40 by one of the most preferred and accepted reflecting configurations (the parabola) in luminaire reflectors.

Figure 12:
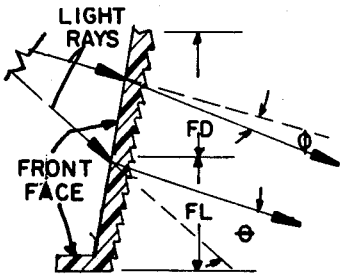
FIG. 12 is a partial elevational view, illustrating the external depressing and lifting prism regions of the front wall of the invention's refractor.

The internal prisms on the front wall of lens 45 are divided into three groups, F1, F2, and F3, each of which function differently to deviate light passing therethrough. Light engaging the centrally disposed group F2 (aligned with the end of the arc tube of the invention's light source) is deviated in two directions, both to the right and left of a plane passing perpendicularly through the front surface and through the nadir (NADIR) in FIG. 7 passing through the center of the arc tube to the surface below the luminaire. This plane is shown as P—P in FIG. 10. In comparison, light passing through adjacent groups F1 and F3 is deflected at a slight angle to the left and right, respectively, of said plane. The external prisms of the front wall are in turn divided into two different functioning groups FD and FL which each run the entire lwidth of the front wall and are each of approximately the same height (as shown). Those external prisms in group FD are classified as being depressing while those in group FL are termed lifting prisms. In other words, these depressing prisms serve to bend each light ray more toward the face (or bottom, in FIG. 7) of the luminaire than the corresponding lifting prisms by deflecting each ray at a slight angle ($\phi$) toward the face from a straight line extending through this portion of the lens and representing a ray not subjected to the aforementioned being. Such a projection is illustrated in FIG. 12. In comparison, each external lifting prism functions to deflect each ray passing therethrough to the opposite side (more toward the top or reflector portion of the invention) of such an extending projection of the ray by also only a slight angle ($\theta$). The end result of the above is that each ray impinging on the front wall of the lens 45 is subjected to a double binding thereof such that it can contribute to a predetermined portion of the distribution below luminaire 10.

Figure 10:
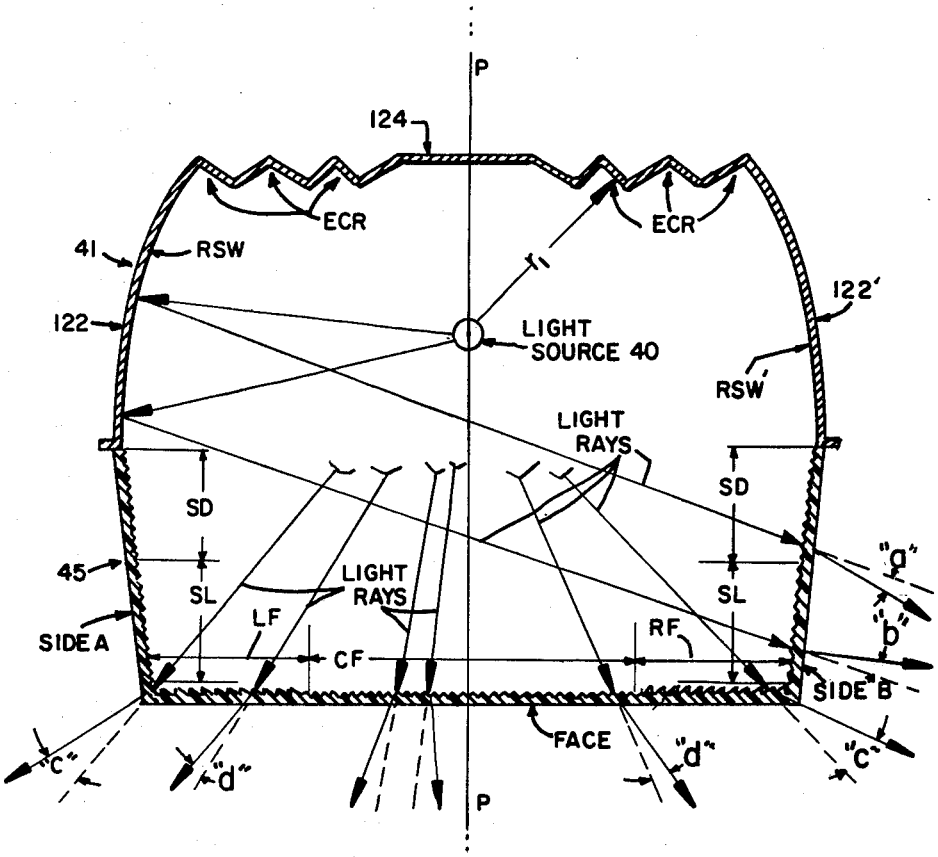
FIG. 10 is an end, elevational view, in section, of the invention's reflector and prismatic lens members, illustrating how the direct and reflected light from the light source of the invention is deviated by the lens member.

With particular regard to FIGS. 7, 10, and 11, the light striking each of the internal reflective surface of the opposing side walls 122 and 122' of reflector 41 is directed downwardly to an opposing one of the sides (A,B) of refractor 45. Specifically, light reflected from the internal surfaces of side 122 is directed onto the internal prisms of opposing side B of the refractor while light from side 122' is reflected to side A (see esp. FIG. 10). The internal surfaces of side 122 are indicated by the designation RSW while those of side 122' are shown by the designation RSW' in FIG. 11. In profile (FIG. 11), the surfaces RSW comprise a stepped parabola (similar to surfaces RBW) having a relatively large parabolic facet 123 with smaller, stepped facets adjacent to both ends thereof. Those facets toward the front of the reflector are progressively smaller as they approach the front while those to the rear (left of facet 123 in FIG. 11) are of approximately the same width and height. Use of this stepped arrangement enables the parabolic contour to be arranged in a substantially linear pattern in much the same manner as the facets RBW such that the desired rectangular configuration for reflector 41 can be obtained. It is understood tht the stepped parabolic configuration is positioned relative to the arc length (light source) of the HID lamp 40, only said length shown in FIGS. 7, 10 and 11. The internal surfaces RSW' of side 122' are similrly arranged (stepped parabolic in profile) and of the same size so further description is not deemed necessary.

Figure 8:
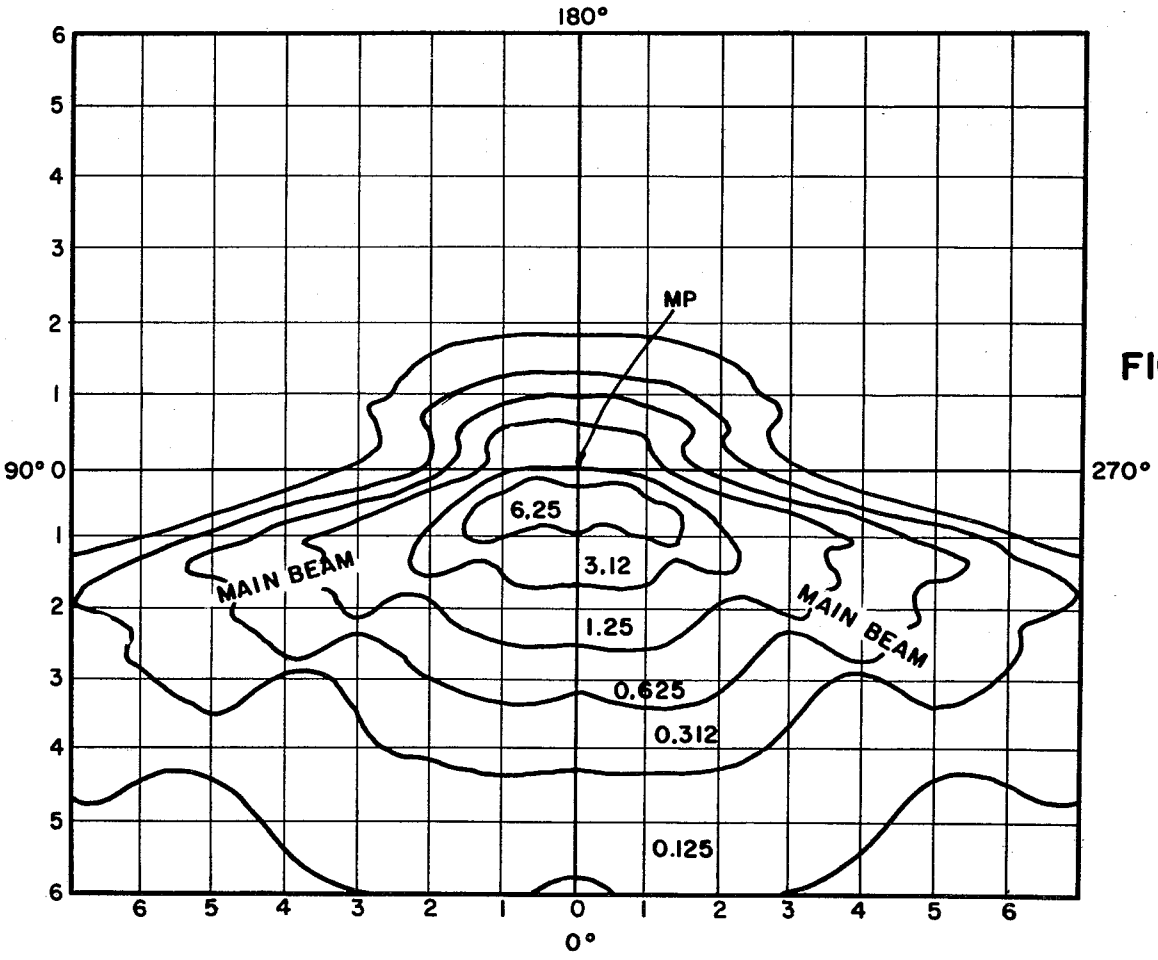
FIGS. 8 and 9 represent examples of isolux plots of horizontal footcandles as produced by the invention while operating in its vertical and horizontal modes, respectively.
Figure 9:
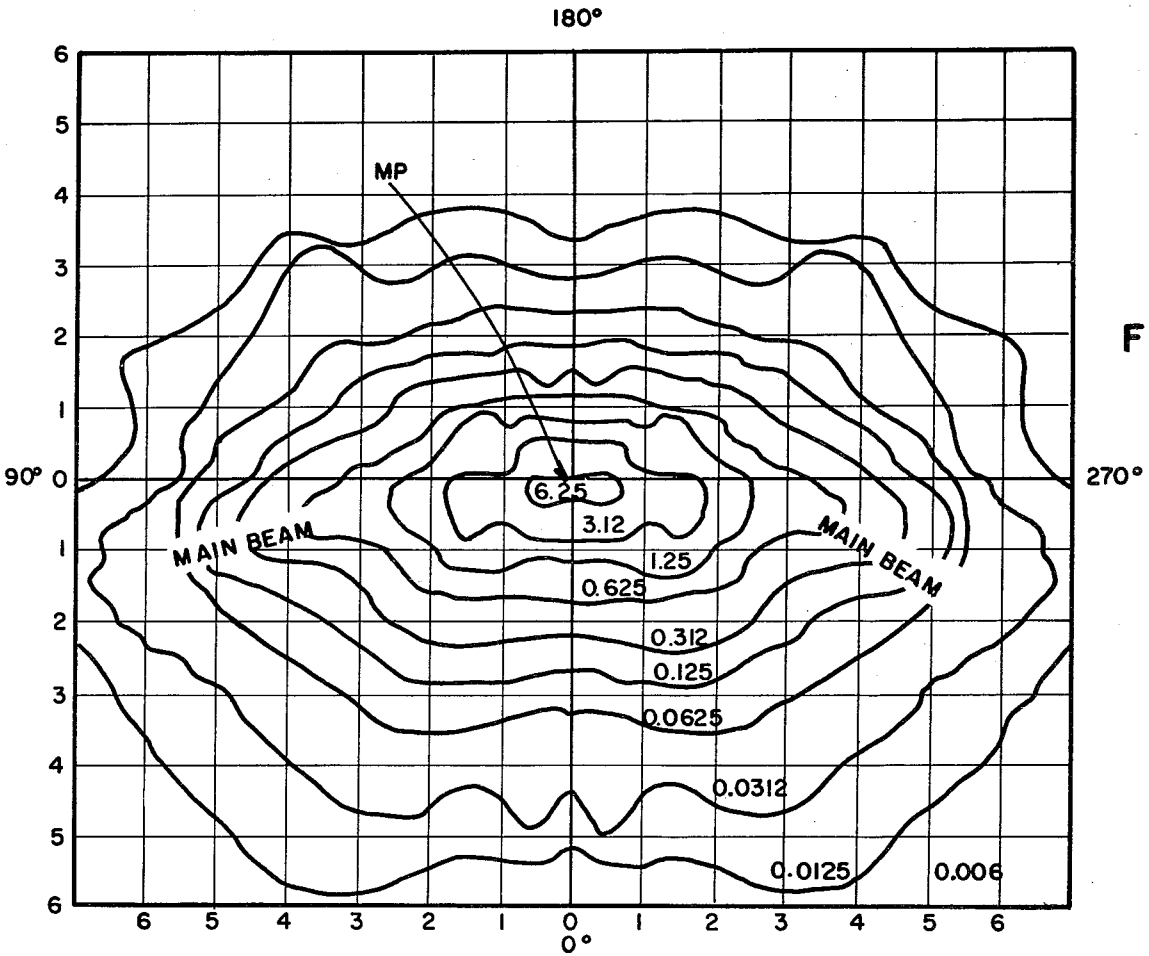

As stated, light from surfaces RSW is reflected primarily onto opposing side B and passes therethrough to designated locations of the distribution. In FIG. 10, it can be seen that the internal prisms of side B (as well as opposing side A) are divided into two functioning groups SD and SL, which serve to bend the light rays impinging thereon in different directions. Specifically, the internal prisms in group SD (which run the entire length of side B) depress the light rays at a slight angle "a" toward the face of refractor 45 (from a straight line extension of the ray if not so bent) while the internal prisms in group SL "lift" the rays (angle "b") toward the reflector from a straight line extension thereof. The external prisms of each side A and B of refractor 45 are also divided into two functioning groups SB and SF (FIG. 7). Specifically, light rays passing through these prisms are subjected to a second bending thereof, the first having been performed by the internal prisms as defined above. Those rays passing through group SF are bent forward (toward the street side) of a straight line extension of each ray while those passing through group SB are bent backwardly (toward the house side) at a slight angle from such a straight line extension. Thus, each ray which is reflected from either of the stepped parabolic reflecting surfaces located on the interior of the reflector's sides 122 or 122' is thereafter subjected to a dual bending operation by the opposed prisms located within one of the corresponding sides (A or B) of refractor 45 to thus assure proper direction thereof onto the predesignated locations of the light distribution below luminaire 10. It should be understood that light reflected from surfaces RSW and RSW', as well as that reflected from the cylindrical top surfaces (described below) of reflector 41 and the direct light from lamp 40, contribute to define the "main beams" of light output from the invention, or in other words, the areas of greatest light concentration. Accordingly, the invention provides at least two of said "main beams" while arranged either horizontally or vertically to provide the desired illumination of the surface (e.g., roadway) below luminaire 10. The approximate locations of these beams are shown in FIGS. 8 and 9 relative to the isolux plots of horizontal footcandle patterns also depicted therein.

It is understood that the internal and external prisms in opposing side B of refractor 45 are divided in similar functioning groups as those in side A, and that these prisms cooperate in the same manner with the opposing reflector side wall (122') so further description is not considered necessary.

With added reference to FIG. 11, the internal reflective surfaces (CR) in each of the corner regions of the rectangular reflector are of spherical configuration to provide sufficient blending between the opposed, steped parabolic facets approaching each corner.

The top reflecting surface of reflector 41 includes six individual elongated elements ECR which are each of substantially cylindrical configuration relative to the arc length therebelow. In cross-section (FIG. 10), these elements are shown as being oriented at progressively increasing radii (i.e., $r_1$) from the light source and thus serve to contribute to the aforementioned "main beams." Light reflected from each of these elongated elements, as well as that reflected from the remaining, substantially flat and tapered forward portion 124 of the reflector's top surfce and the spherical rearward region (125 in FIG. 2 and 11) thereof, is directed primarily onto a forward portion FFR of the refractor's planar face member, where it is subjected to a double bending thereof in much the same manner and provided by the aforedescribed, remaining walls of refractor 45. Specifically, the external prisms of portion FFR (which run the entire width of the face) direct the light rays passing therethrough in a forward manner (toward the street side) at a slight angle from a straight line extension thereof relative to the reference line shown in FIG. 7. Even more particularly, this external bending occurs at a progressively increasing rate (greatest deviation occuring at the portion of the face member immediately adjacent the refractor's front lens component) to contribute to the distribution therebelow. In cross-section (FIG. 10), the internal prisms of portion FFR are divided into three separate groups (RF, CF, LF), each functioning differently with respect to impinging light rays. These internal prisms located below the arc length (shown as occupying region CF) bend the light rays in two opposing directions, as indicated, to provide a smoothing effect on the emitted light and especially on that directly emitted by the invention's HID light source. Light rays impining on outer groups RF and LF are deviated at a progressive rate away from the vertical plane P—P. An example of this progressively increasing (greatest at the extreme outer corners of the refractor) deviation is shown in FIG. 10. As shown, the angle of deviation at the outermost portions of the face, indicated as angle "c," is greater than the deviation in the area nearer central group CF, indicated as angle "d."

To provide even further smoothing of light directly emitted by the invention's light source, there is provided a substantially rectangular-shaped, centrally disposed group LRF (FIG. 7) of external prisms in the face of refractor 45 immediately below the light source and of approximately the same length as its arc length. These external prisms serve to deviate direct light in both a forward (toward street side) and rearward (house side) direction. Accordingly, one looking directly upward into the invention will not be subjected to the intensely bright, direct rays from the HID arc length therein. It is to be understood that the internal prisms of group LRF function in the same manner as those of group CF described above.

Light impinging on the remaining part of reflector 41, the internal surfaces of the front reflecting wall 127, is directed primarily onto the rearward portion of the rfractor's face, indicated in FIG. 7 as area RFR. These internal surfaces, designated as RFW in FIG. 11, are in the form of a stepped parabola much like the remaining surfaces RBW, RSW, and RSW'. Specifically, this portion of the reflector includes a substantially parabolic (in profile) large reflecting facet 129, which if extended would form a parabola relative to the arc length light source 40. The opposing end surfaces, however, are stepped (in a progressively decreasing manner toward the outer corners of the reflector) in order that they can be substantially linearly arranged to occupy this wall of the reflector. In elevation, the contour of each of these surfaces, like those on side walls 122 and 122' as well as rear wall 120, is also parabolic.

As stated, light reflected from surfaces RFW impinges primarily on portion RFR of the refractor's face member. The internal prisms of this portion are divided into three separate groups, which essentially are mere extensions of the aforedefined groups (RF, CF, LF) of forward portion FFR. As such, each of these groups, illustrated in FIG. 7 by the designates RF', CF', and LF', functions essentially the same with regard to deviation of incoming light rays. Further description is thus not deemed necessary. The external prisms in portion RFR operate somewhat differently, however, from their counterparts in forward portion FFR, depending on the distribution desired. In the event that an I.E.S. type II distribution is desired, the external prisms in the entirety of portion RFR function to deviate light passing therethrough in a direction toward the house side part of the distribution, whereas if a type III distribution is desired, this portion is divided into two substantially equally width groups of prisms with those located along the extreme end surface of the lens functioning to deflect light rays forward (toward street side) while those located in this part adjacent the forward portion FFR function to deviate light rays in an opposing manner, or toward the house side. The aforementioned forward bending by this divided portion of the lens serves to increase the overall width of the resulting distribution, thus making it a type III.

It can therefore be seen that the invention comprises the use of a recessed, substantially rectangular reflector having diversely-shaped surfaces therein (parabolic, cylindrical, spherical and flat) in combination with a multiplanar refracting lens having several prisms located on the opposite surfaces of each wall thereof to in turn provide a dual bending or deviation of each light ray impinging thereon. This unique combination enables the invention, when using the elongated light source defined, to provide either a I.E.S. type II or III medium, semi-cutoff distribution when the luminaire is horizontally aligned and a type IV long distribution when it functions vertically (e.g., as when attached flush to a wall). To enhance this output, each of the internal reflective surfaces of the invention's reflector is preferably specularly reflective. To achieve this, the reflector is preferably highly polished or vacuum metallized aluminum, as described above.

In FIGS. 8 and 9, there are shown isolux plots of horizontal footcandles as produced by the invention on a planar surface therebelow while operating in its vertical and horizontal modes, respectively, and while utilizing the aforementioned HID, 70 watt, high pressure sodium lamp. With particular reference to FIG. 8, the mid-point MP of the graph represents a point directly below the vertically oriented arc length with the 90°-270° line representing the reference line in FIG. 7. Accordingly, the portion of the graph above this line repesents the house side of the distribution while the portion below represents the street side. Each block (or square) in the graph constitutes a distance equal to the invention's mounting height. Accordingly, should a mounting height of 12 feet be shown (as actually is), the extreme end edges (right and left) of the graph represent a total distance of 84 feet from mid-point MP. In comparison, the forwardmost (street side) edge of the graph, as well as the rearwardmost, constitutes a distance of 72 feet. With luminaire 10 oriented vertically and using the described lamp, the region of highest illumination is thus shown to possess an average reading of 6.25 footcandles almost immediately below the luminaire and in a direction right and left for a distance of about 16 feet, and a forward distance of about 12 feet. The remaining levels of illumination provided by the invention can be readily discerned from the graph in FIG. 8. It is of course understood that the invention is fully capable of providing greater illumination readings using lamps possessing higher outputs, or by simply reducing the mounting height (e.g., to 8 feet) using the described lamp.

In FIG. 9, the invention possessing the same reflector-lamp-lens combination producing the isolux plot in FIG. 8 has been positioned in a horizontal orientation (e.g., FIG. 5 or 6). The resulting plot of horizontal footcandles is shown as being much broader on the planar surface below the luminaire (at the same mounting height of 12 feet) than that shown in FIG. 8 and also substantially more uniform relative to opposing sides of the reference line 90°-270°. The mid-point MP is understood to repesent a point of intersection between the planar surface and a line drawn vertically through the center of the horizontally disposed arc length. The levels and plan of illumination depicted in FIG. 9 clearly illustrates that the invention when horizontally arranged is ideally suited for illuminating such surfaces therebelow as roadways. In comparison, the vertically oriented invention is also shown in FIG. 8 as being ideally suited for adequately illuminating surfaces of narrower dimensions, such as alleyways.

The preferred ratio of distance to mounting height for the invention when providing a type II distribution is approximately 8:1 while that for a type III distribution is about 7.5:1. Typical operating efficiencies (output) for the horizontally operating device range between about 50 to about 60 percent, while efficiencies in the vertical mode approach 40 percent.

While there have been shown and described what are at present considered the preferred embodiments of the invention, it will be obvious to those skilled in the art that various changes and modifications may be made therein without departing from the scope of the invention as defined by the appended claims.

We claim:

1. A luminaire comprising:

a boxlike, two-part housing;

an elongated light source positioned within said housing;

a reflector positioned within one of said parts of said housing and adapted for having said elongated light source oriented substantially therein, said reflector including a plurality of reflecting surfaces of different configurations; and a multiplanar, prismatic lens located adjacent said reflector for having both the direct light from said light source and the light reflected by said reflector pass therethrough, each of said reflecting surfaces of said reflector reflecting light from said elongated light source onto predetermined portions of said prismatic lens such that said luminaire will produce a first light distribution below said luminaire when said luminaire is positioned in a substantially horizontal orientation and a second light distribution different from said first light distribution below said luminaire when said luminaire is positioned in a substantially vertical orientation, said luminaire operable in both of said orientations.

2. The luminaire according to claim 1 wherein said light source is a high intensity discharge lamp having an elongated arc length.

3. The luminaire according to claim 2 wherein said high intensity discharge lamp is selected from the group consisting of high pressure sodium, metal halide, and mercury lamps.

4. The luminaire according to claim 1 wherein said first light distribution produced by said luminaire while positioned in said substantially horizontal orientation is an I.E.S. type II distribution, and said second light distribution produced by said luminaire in said substantially vertical orientation is an I.E.S. type IV distribution.

5. The luminaire according to claim 4 wherein said I.E.S. type II distribution is a medium, semi-cutoff distribution, and said I.E.S. type IV distribution is a long distribution.

6. The luminaire according to claim 1 wherein said first light distribution produced by said luminaire while positoned in said substantially horizontal orientation is an I.E.S. type III distribution, and said second light distribution produced by said luminaire in said substantially vertical orientation is an I.E.S. type IV distribution.

7. The luminaire according to claim 6 wherein said I.E.S. type III distribution is a medium, semi-cutoff distribution and said I.E.S. type IV distribution is a long distribution.

8. The luminaire according to claim 1 wherein said reflector is of substantially rectangular configuration having four adjoining reflective side walls and a reflective top wall, said reflector further including a substantially rectangular opening, the light from said light source reflected by said reflective side and top walls passing through said opening.

9. The luminaire according to claim 8 wherein in profile the internal reflective surfaces of each of said side walls of said reflector are of a substantially parabolic configuration arranged in a plurality of stepped facets along each respective side wall.

10. The luminaire according to claim 9 wherein in elevation each of said stepped facets is of a substantially parabolic configuration.

11. The luminaire according to claim 9 wherein said reflector includes four reflective corner portions interconnecting said side walls, the reflective surfaces of each of said corner portions of substantially spherical configuration.

12. The luminaire according to claim 8 wherein said reflective top wall includes a plurality of individual reflecting elements located therein, each of said elements of substantially cylindrical configuraton in relation to the length of said elongated light source.

13. The luminaire according to claim 12 wherein said top wall of said reflector further includes a substantially flat reflective surface and a curved surface of substantially spherical configuration.

14. The luminaire according to claim 1 wherein the number of planar refracting walls of said prismatic lens is four, each of said refracting walls including a plurality of prisms on opposing surfaces thereof.

15. The luminaire according to claim 14 wherein each of said planar refracting walls performs a double bending of each light ray from said light source and said reflector passing therethrough to direct said light rays onto said distributions below said luminaire.

* * * * *